United States Patent [19]

Grim

[11] Patent Number: 4,623,299

[45] Date of Patent: Nov. 18, 1986

[54] DRIVING ARRANGEMENT FOR WATERCRAFT

[75] Inventor: Otto Grim, Hamburg, Fed. Rep. of Germany

[73] Assignee: Harmstorf AG, Flensburg, Fed. Rep. of Germany

[21] Appl. No.: 691,455

[22] Filed: Jan. 14, 1985

[30] Foreign Application Priority Data

Jan. 14, 1984 [EP] European Pat. Off. ..... 84100358.5

[51] Int. Cl.[4] ..... B63H 1/26

[52] U.S. Cl. ..... 416/124; 416/171; 416/175

[58] Field of Search ..... 416/171, 175 R, 124, 416/120

[56] References Cited

U.S. PATENT DOCUMENTS 3,549,271 12/1970 Kubota ..... 416/124

FOREIGN PATENT DOCUMENTS 1556851 1/1970 Fed. Rep. of Germany ..... 416/124
1756889 1/1970 Fed. Rep. of Germany ..... 416/124
528957 11/1921 France ..... 416/124
332124 7/1930 United Kingdom ..... 416/124

OTHER PUBLICATIONS

Das Grim'sche Leitrad, Bulletin.
Propeller and Vane Wheel, *Journal of Ship Research*, published Dec. 1980, pp. 203–226.

*Primary Examiner*—Everette A. Powell, Jr.
*Attorney, Agent, or Firm*—Karl F. Ross; Herbert Dubno

[57] ABSTRACT

A driving arrangement for a watercraft includes a propeller and a freely pivoted guide wheel arranged subsequently to the propeller. The guide wheel which has a higher blade number and a smaller rotational speed than the propeller is provided with sectionized blades. One segment of each blade is propeller blade-like and extends outside the stream generated by the propeller and the other segment is turbine bucket-like and extends within the propeller stream. Upon equal rotational speed of the propeller and the guide wheel, the pitch of the respective segments is such that the pitch of the one segment which is outside the propeller stream is essentially constant in radial direction while the pitch of the other segment steadily increases radially from the one segment towards the hub on which the guide blade is arranged.

4 Claims, 4 Drawing Figures

DRIVING ARRANGEMENT FOR WATERCRAFT

FIELD OF THE INVENTION

My present invention relates to a driving arrangement for watercraft.

BACKGROUND OF THE INVENTION

From the German Patent DE-PS No. 17 56 889, an arrangement is known including a ship's propeller or screw cooperating with a freely pivoted guide wheel trailing the propeller. The guide wheel has a number of blades greater than that of the propeller and a rotational speed which is lower than the one of the propeller. Each blade of the guide wheel has an inner section which is formed as a turbine blade and is disposed within the stream generated by the propeller or screw and another segment which is shaped as a propeller blade and lies outside the screw propeller stream.

In such a driving arrangement, the flow energy contained in the propeller stream behind the ship is partly converted into mechanical energy, of which one part is used for driving the guide wheel and another part is converted by the thus rotated turbine into propulsion energy by those blade segments of the guide wheel which are outside the propeller stream and thus generate a propulsion stream outwardly of the first-mentioned propulsion stream.

For hydrodynamic reasons, such an arrangement allows significant gain of additional propulsion energy in comparison to conventional propellers only when—as I have already mentioned—the number of blades of the guide wheel is greater than that of the main propeller and the rotational speed of the guide wheel or auxiliary drive is lower than that of the main propeller.

Despite the additional investments incurred by such an arrangement in comparison to conventional propellers, the obtained energy recovery is significant, especially when considering the ever increasing fuel costs for ships. On the other hand, such an arrangement has proven to be difficult to design and to construct in view of the complex hydrodynamic relationships involved.

OBJECT OF THE INVENTION

It is thus the principal object of my invention to provide an improved driving arrangement obviating the afore-stated difficulties.

SUMMARY OF THE INVENTION

I realize this object according to the invention by providing a propeller and a guide wheel rotatable in the same direction of rotation and by dividing the guide wheel into two segments. One segment of each auxiliary wheel blade lies outside the generated or main propulsion propeller stream and has a pitch at an essentially constant value radially, and the other (turbine) segment extending within the main propulsion stream has a pitch steadily increasing from that constant value radially in the direction of and to the hub of the guide wheel and by which it is mounted on the shaft.

It is known that the pitch characteristic of the radial blade segments of a propeller or a guide wheel essentially determines its hydrodynamic properties. I have now found that with the same direction of rotation of the propeller and the guide wheel, a steadily, especially primarily linearly increasing pitch characteristic toward the hub of the turbine blade segment which extends within the propeller stream provides surprisingly effective results regardless whether the auxiliary propeller is a freely running propeller or a so-called slipstream propeller.

In addition, an essentially linear pitch characteristic of the segment extending outside the propeller stream facilitates design, construction and manufacture of the guide wheel. Since guide wheel and main propeller rotate in the same direction, a relatively small blade frequency is obtained so that the vibrating action of the arrangement according to the invention is minimized.

In case the guide wheel is supported at the propeller hub, the design of the bearing and the respective sealing is facilitated as well since the relative rotational speed between guide wheel and propeller is small. Moreover, the constant pitch of the segment extending outside the propeller stream allows a simplification of the manufacture of the guide wheel. This, however, does not preclude an adjustment of the constant pitch segment to accommodate a possibly existing slipstream field.

According to a further feature of the invention, the pitch of the radial blade segments of the guide blade in vicinity of the hub is 1.5 to 3 times the constant value. The constant value which corresponds to the constant pitch of the segment outside the propeller stream is 2 to 3 times the propeller pitch.

When designing an arrangement according to the invention, so-called optimum propellers are considered and referred to which have an optimum diameter adjusted to the speed of the drive motor of the ship as well as to the slipstream conditions and to the propeller well. Since the space of the propeller well is limited, problems might be expected when substituting the optimum propeller by an arrangement of a propeller and a guide wheel.

I have found, however, that by providing a propeller which is of smaller diameter than the optimum diameter but of the same speed, the space problems are overcome, and nevertheless the advantages of the invention which primarily reside in the energy recovery are obtained.

Consequently, the diameter of the propeller can be reduced upon equal speed without any requirement to increase e.g. the number of blades of the propeller as long as the pitch of the propeller reduced in diameter is higher than the pitch of the optimum propeller.

I may note that these conditions also prevail when using a controllable-pitch propeller or a shrouded propeller.

BRIEF DESCRIPTION OF THE DRAWING

The above and other features of my present invention will now be described in detail with reference to the accompanying diagrammatic drawing in which.

SPECIFIC DESCRIPTION

Figure 1:
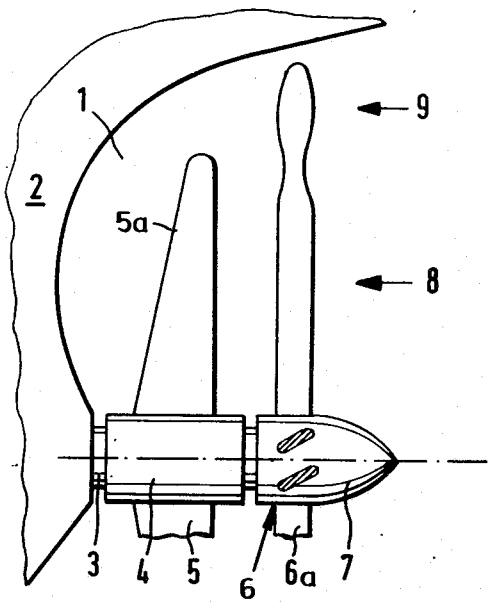
FIG. 1 is a schematic illustration of a driving arrangement of a propeller and a guide wheel.

FIG. 1 shows a propeller well 1 arranged at the stern 2 of a watercraft or ship. Projecting from the stern 2 is a propeller shaft 3 which supports and drives a main propeller hub 4 carrying radially extending blades 5*a* of an associated propeller 5.

A freely rotating hub 7 which carries a guide wheel 6 is arranged on the shaft 3 in flow direction of the propeller 5 at a distance to the hub 4 and at the side of the latter facing away from the stern 2. The guide wheel 6 includes a number of blades 6*a* extending radially from the hub 7 which is arranged in a freely pivoted manner in vicinity of the hub 4 of the propeller 5. I may note that the support hub 7 is not shown in detail as it does not form part of the invention and can be provided in any conventional way. As is clearly shown in FIG. 1, the guide wheel 6 has a larger diameter than the propeller 5, and in addition, I may note that the guide wheel 6 has a greater number of blades than the propeller 5.

Figure 3:
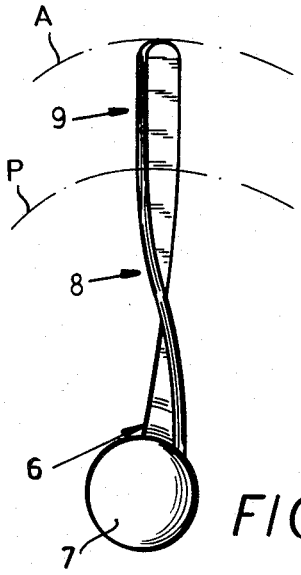
FIG. 3 is s a fragmentary end view of the guide wheel showing one blade.

Turning now to FIG. 3, it may be seen that each blade 6*a* of the guide wheel 6 is sectionized into two distinct segments. A first segment 8 which is arranged within the propeller stream P and is approximately of same radius as the blades 5*a* of the propeller 5 is shaped in form of a turbine bucket, and a second segment 9 is provided in the shape of a propeller blade and extending outside of the propeller stream in elongation of the segment 8. The pitches of the segments 8 of each blade 6*a* are directed in such a manner that the guide wheel 6 is driven in the same direction of rotation as the propeller 5, however, at a smaller speed. Consequently, the other segments 9 of the blades 6—located outside the propeller stream—are then provided to generate an additional propulsion stream A.

Figure 2:
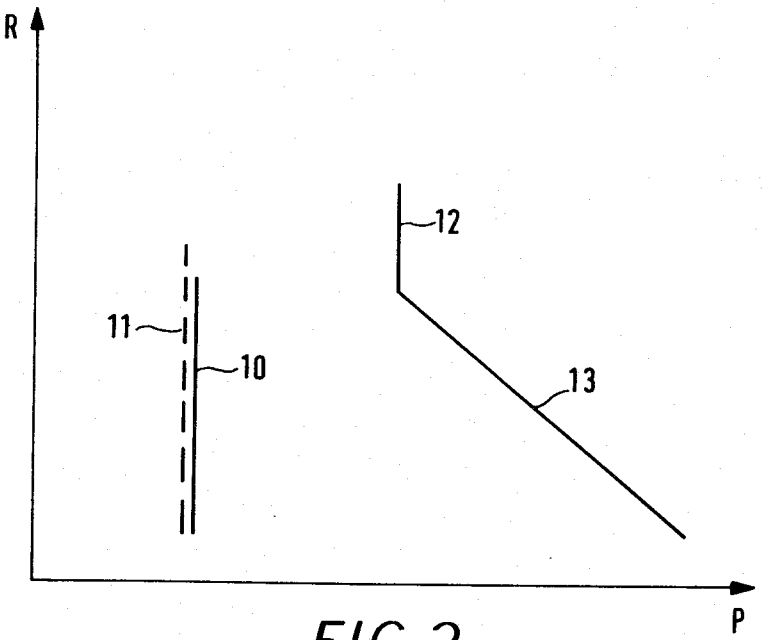
FIG. 2 is a diagram illustrating the pitch characteristic in dependence on the radius of the propeller and the guide wheel.

In FIG. 2, a diagram is shown illustrating the pitch P of the propeller 5 and the guide wheel 6 in dependence on the radius R. As illustrated by continuous line 10, the propeller 5 has an approximately constant pitch which, if necessary, can be adjusted to a slipstream field. For comparison, by dotted line 11 the pitch of an optimum propeller is illustrated as well, which, as can be seen, has a larger diameter than the propeller 5. The pitch 11 is also approximately constant, however, it is somewhat smaller than the pitch 10 of the propeller 5.

The right portion of the diagram illustrates the pitch of the radial blade segments 8, 9 of the guide wheel 6. As can be seen therefrom, the segments 9 extending outside the propeller stream have in radial direction approximately a constant pitch as indicated by line 12. As the case may be, this pitch characteristic can be adjusted to a slipstream field if necessary. The segment 8 arranged within the propeller stream shows a pitch characteristic steadily and linearly increasing from the approximately constant pitch 12 in direction to the hub 7, as indicated by line 13.

It is preferred to provide the constant value of the pitch 12 outside the propeller stream about 2 to 3 times the pit 10 of the propeller 5. The pitch 13 of the segment 8 in the area of the hub 7 is about 1.5 to 3 times the constant value of the pitch 12.

This basic pitch characteristic 12, 13 is also valid in arrangements in which the propeller 5 having constant pitch is substituted by a slipstream propeller, a controllable-pitch propeller or a shrouded propeller.

In the illustrated embodiment and by way of specific example, the propeller 5 has a diameter of approximately 5.2 m. In comparison, the optimum propeller would have had a diameter of 5.6 m. The mean pitch 10 of the propeller 5 is about 5.1 m. The guide wheel 6 has a diameter of 6.7 m. Its blades 6*a* have a pitch 12 of approximately 11.8 m in the segment 9 outside the propeller stream while the pitch 13 of the radial blade segment 8 at the hub 7 is approximately 22.3 m.

The arrangement according to the invention has an efficiency of about 0.69 in comparison to an efficiency of 0.65 for an optimized propeller.

Figure 4:
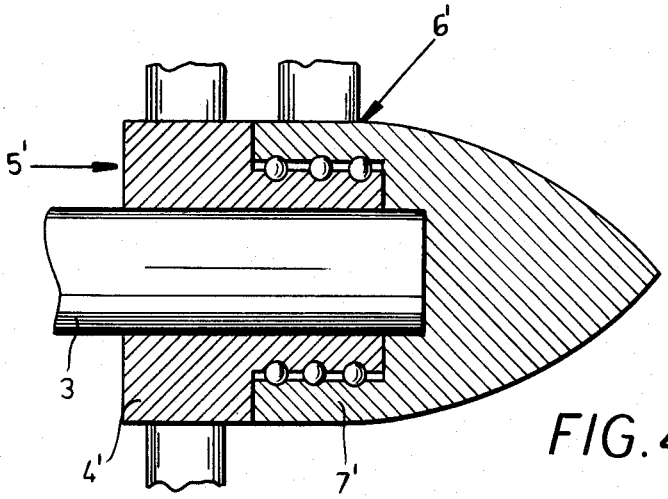
FIG. 4 is a section showing an embodiment in which the guide wheel is mounted on the main propeller hub.

As can be seen from FIG. 4, the hub 4' of the driven propeller 5' can rotatably support the hub 7' of the guide wheel 6' in another embodiment otherwise constructed in the manner described.

I claim:

1. A watercraft drive comprising:

a propeller having a given number of blades and a rotational speed, said propeller providing a main propulsion stream; and a guide wheel freely rotatable downstream of said propeller and having a number of blades greater than the number of blades of said propeller and a rotational speed smaller than the rotational speed of said propeller, said blades of said guide wheel each having one segment lying within said stream and being shaped as turbine blades and another segment extending outside the propeller stream and being shaped in a propeller blade-like manner, said propeller and said guide wheel being rotatable in the same direction of rotation and said segment extending outside the propeller stream having a pitch essentially at a constant value in radial direction and said segment lying within said stream having a pitch increasing steadily radially from said constant value to a hub of said guide wheel.

2. A watercraft drive as defined in claim 1 wherein the pitch of said segment lying within said stream increases essentially linearly towards said hub of said guide wheel.

3. A watercraft drive as defined in claim 1 wherein the pitch of said segment lying within said stream at said hub is about 1.5 to 3 times of said constant value.

4. A watercraft drive as defined in claim 1 wherein the pitch of said segment extending outside the propeller stream is about two to three times the pitch of said propeller.

* * * * *